US006761800B2

(12) United States Patent
Capizzi

(10) Patent No.: US 6,761,800 B2
(45) Date of Patent: Jul. 13, 2004

(54) PROCESS FOR APPLYING A LIQUID ADDITIVE TO BOTH SIDES OF A TISSUE WEB

(75) Inventor: Joseph G. Capizzi, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 60 days.

(21) Appl. No.: 10/281,886

(22) Filed: Oct. 28, 2002

(65) Prior Publication Data

US 2004/0079502 A1 Apr. 29, 2004

(51) Int. Cl.[7] ..... D21H 23/50; D21H 21/22; D21H 23/22

(52) U.S. Cl. ..... 162/184; 162/158; 162/157.1; 162/164.1; 162/135; 427/391

(58) Field of Search ..... 162/135, 184, 162/137, 136, 158, 164.1, 157.1–157.2; 424/402; 428/447, 452, 156; 427/420, 424, 391, 361, 331, 411, 356, 358, 395; 156/167, 178, 285; 264/171.21, 173.125, 555

(56) References Cited

U.S. PATENT DOCUMENTS

| | | | |
|---|---|---|---|
| 2,345,543 | A | 3/1944 | Wohnsiedler et al. |
| 2,926,116 | A | 2/1960 | Keim |
| 2,926,154 | A | 2/1960 | Keim |
| 3,556,932 | A | 1/1971 | Coscia et al. |
| 3,556,933 | A | 1/1971 | Cosia et al. |
| 3,700,623 | A | 10/1972 | Keim |
| 3,722,469 | A | 3/1973 | Bartley et al. |
| 3,772,076 | A | 11/1973 | Keim |
| 3,849,241 | A | 11/1974 | Butin et al. |
| 3,865,078 | A | 2/1975 | De Howitt et al. |
| 3,885,158 | A | 5/1975 | Flutie et al. |
| 3,899,388 | A | 8/1975 | Petrovich et al. |
| 3,905,329 | A | 9/1975 | Cone et al. |
| 3,930,465 | A | 1/1976 | Schuierer |
| 4,005,028 | A | 1/1977 | Heckert |
| 4,005,030 | A | 1/1977 | Heckert |
| 4,016,831 | A | 4/1977 | James et al. |
| 4,023,526 | A | 5/1977 | Ashmus et al. |
| 4,061,001 | A | 12/1977 | Von Der Eltz et al. |
| 4,081,318 | A | 3/1978 | Wietsma |
| 4,089,296 | A | 5/1978 | Barchi |
| 4,099,913 | A | 7/1978 | Walter et al. |
| 4,118,526 | A | 10/1978 | Gregorian et al. |
| 4,129,528 | A | 12/1978 | Petrovich et al. |
| 4,147,586 | A | 4/1979 | Petrovich et al. |
| 4,158,076 | A | 6/1979 | Wallsten |
| 4,159,355 | A | 6/1979 | Kaufman |
| 4,184,914 | A | 1/1980 | Jenkins |
| 4,193,762 | A | 3/1980 | Namboodri |
| 4,198,316 | A | 4/1980 | Nahta |
| 4,222,921 | A | 9/1980 | Van Eenam |
| 4,230,746 | A | 10/1980 | Nahta |
| 4,237,818 | A | 12/1980 | Clifford et al. |

(List continued on next page.)

FOREIGN PATENT DOCUMENTS

| | | |
|---|---|---|
| DE | 252208 | 10/1912 |
| EP | 0047908 A1 | 3/1982 |
| EP | 0098362 B1 | 1/1984 |

(List continued on next page.)

*Primary Examiner*—José A. Fortuna
(74) *Attorney, Agent, or Firm*—Dority & Manning, P.A.

(57) ABSTRACT

A method is disclosed for topical application of compositions containing a chemical additive onto a paper web. The present invention is also directed to paper products formed from the method. In general, the method includes the steps of applying a composition containing a chemical additive onto a first side of a paper web. The paper web is then wound into a roll. During winding, a portion of the composition transfers from the first side of the web to the second side of the web. Thus, both sides of the web become treated with the composition through a single application of the composition to the web.

31 Claims, 4 Drawing Sheets

U.S. PATENT DOCUMENTS 4,263,344 A 4/1981 Radvan et al.
4,276,339 A 6/1981 Stoveken
4,279,964 A 7/1981 Heller
4,288,475 A 9/1981 Meeker
4,297,860 A 11/1981 Pacifici et al.
4,305,169 A 12/1981 Vidalis
4,343,835 A 8/1982 Jones et al.
4,348,251 A 9/1982 Pauls et al.
4,364,784 A 12/1982 Van Wersch et al.
4,366,682 A 1/1983 Keller
4,384,867 A 5/1983 Grüber
4,385,954 A 5/1983 Pauls et al.
4,387,118 A 6/1983 Shelton
4,400,953 A 8/1983 Driessen et al.
4,402,200 A 9/1983 Clifford et al.
4,435,965 A 3/1984 Sasseville et al.
4,440,808 A 4/1984 Mitter
4,442,771 A 4/1984 Mitter
4,444,104 A 4/1984 Mitter
4,453,462 A 6/1984 Mitter
4,463,467 A 8/1984 Grüber et al.
4,463,583 A 8/1984 Krüger et al.
4,474,110 A 10/1984 Rosner
4,497,273 A 2/1985 Mitter
4,498,318 A 2/1985 Mitter
4,501,038 A 2/1985 Otting
4,502,304 A 3/1985 Hopkins
4,534,189 A 8/1985 Clifford
4,552,778 A 11/1985 Zimmer
4,557,218 A 12/1985 Sievers
4,559,243 A 12/1985 Pässler et al.
4,562,097 A 12/1985 Walter et al.
4,571,360 A 2/1986 Brown et al.
4,576,112 A 3/1986 Funger et al.
4,581,254 A 4/1986 Cunningham et al.
4,597,831 A 7/1986 Anderson
4,603,176 A 7/1986 Bjorkquist et al.
4,605,702 A 8/1986 Guerro et al.
4,612,874 A 9/1986 Mitter
4,618,689 A 10/1986 Traver et al.
4,646,675 A 3/1987 Arthur et al.
4,655,056 A 4/1987 Zeiffer
4,665,723 A 5/1987 Zimmer
4,667,882 A 5/1987 Pacifici
4,699,988 A 10/1987 Traver et al.
4,731,092 A 3/1988 Berendt
4,734,100 A 3/1988 Berendt et al.
4,741,739 A 5/1988 Berendt et al.
4,762,727 A 8/1988 Voswinckel
4,773,110 A 9/1988 Hopkins
4,778,477 A 10/1988 Lauchenauer
4,792,619 A 12/1988 Berendt et al.
4,799,278 A 1/1989 Beeh
4,833,748 A 5/1989 Zimmer et al.
4,872,325 A 10/1989 Moser et al.
4,894,118 A 1/1990 Edwards et al.
4,911,956 A 3/1990 Gabryszewski et al.
4,912,948 A 4/1990 Brown et al.
4,943,350 A 7/1990 Bogart et al.
4,950,545 A 8/1990 Walter et al.
5,008,131 A 4/1991 Bakhshi
5,009,932 A 4/1991 Klett et al.
5,048,589 A 9/1991 Cook et al.
5,059,282 A 10/1991 Ampulski et al.
5,089,296 A 2/1992 Bafford et al.
5,098,979 A 3/1992 O'Lenick, Jr.
5,145,527 A 9/1992 Clifford et al.
5,164,046 A 11/1992 Ampulski et al.
5,165,261 A 11/1992 Cho
5,215,626 A 6/1993 Ampulski et al.
5,219,620 A 6/1993 Potter et al.
5,227,023 A 7/1993 Pounder et al.
5,227,242 A 7/1993 Walter et al.
5,237,035 A 8/1993 O'Lenick, Jr. et al.
5,245,545 A 9/1993 Taylor
5,246,545 A 9/1993 Ampulski et al.
5,246,546 A 9/1993 Ampulski
5,328,685 A 7/1994 Janchiraponvej et al.
5,340,609 A 8/1994 Arthur et al.
5,366,161 A 11/1994 Potter et al.
5,385,643 A 1/1995 Ampulski
5,389,204 A 2/1995 Ampulski
5,399,412 A 3/1995 Sudall et al.
5,466,337 A 11/1995 Darlington et al.
5,492,655 A 2/1996 Morton et al.
5,505,997 A 4/1996 Strong et al.
5,510,001 A 4/1996 Hermans et al.
5,525,345 A 6/1996 Warner et al.
5,538,595 A 7/1996 Trokhan et al.
5,552,020 A 9/1996 Smith et al.
5,573,637 A 11/1996 Ampulski et al.
5,591,309 A 1/1997 Rugowski et al.
5,601,871 A 2/1997 Krzysik et al.
5,605,719 A 2/1997 Tench et al.
5,614,293 A 3/1997 Krzysik et al.
5,623,043 A 4/1997 Fost et al.
5,624,676 A 4/1997 Mackey et al.
5,635,469 A 6/1997 Fowler et al.
5,650,218 A 7/1997 Krzysik et al.
5,665,426 A 9/1997 Krzysik et al.
5,667,636 A 9/1997 Engel et al.
5,688,496 A 11/1997 Fost et al.
5,705,164 A 1/1998 Mackey et al.
5,707,434 A 1/1998 Halloran et al.
5,707,435 A 1/1998 Halloran
5,725,736 A 3/1998 Schroeder et al.
5,792,737 A 8/1998 Grüning et al.
5,807,956 A 9/1998 Czech
5,814,188 A 9/1998 Vinson et al.
5,830,483 A 11/1998 Seidel et al.
5,840,403 A 11/1998 Trokhan et al.
5,849,313 A 12/1998 Fost et al.
5,856,544 A 1/1999 Czech et al.
5,857,627 A 1/1999 Horwell et al.
5,861,143 A 1/1999 Peterson et al.
5,869,075 A 2/1999 Krzysik
5,871,763 A 2/1999 Luu et al.
5,882,573 A 3/1999 Kwok et al.
5,885,697 A 3/1999 Krzysik et al.
5,902,540 A 5/1999 Kwok
5,904,298 A 5/1999 Kwok et al.
5,904,809 A 5/1999 Rokman et al.
5,925,469 A 7/1999 Gee
5,935,383 A 8/1999 Sun et al.
5,981,681 A 11/1999 Czech
5,985,434 A 11/1999 Qin et al.
5,990,377 A 11/1999 Chen et al.
6,017,417 A 1/2000 Wendt et al.
6,030,675 A 2/2000 Schroeder et al.
6,033,723 A 3/2000 Kistler et al.
6,054,020 A 4/2000 Goulet et al.
6,077,375 A 6/2000 Kwok
6,090,885 A 7/2000 Kuo et al.
6,103,128 A 8/2000 Koso et al.
6,120,784 A 9/2000 Snyder, Jr.
6,126,784 A 10/2000 Ficke et al.
6,132,803 A 10/2000 Kelly et al.
6,136,147 A * 10/2000 Edwards et al. ..... 162/135
6,179,961 B1 * 1/2001 Ficke et al. ..... 162/127
6,183,814 B1 2/2001 Nangeroni et al.
6,217,707 B1 4/2001 Garvey et al.

| | | | | | |
|---|---|---|---|---|---|
| 6,217,940 | B1 | | 4/2001 | Kuni | |
| 6,231,719 | B1 | | 5/2001 | Garvey et al. | |
| 6,238,518 | B1 | | 5/2001 | Rokman et al. | |
| 6,238,682 | B1 | | 5/2001 | Klofta et al. | |
| 6,306,408 | B1 | | 10/2001 | Eickhorn et al. | |
| 6,322,604 | B1 | | 11/2001 | Midkiff | |
| 6,432,268 | B1 | | 8/2002 | Burghardt | |
| 6,432,270 | B1 | | 8/2002 | Liu et al. | |
| 6,547,928 | B2 | | 4/2003 | Barnholtz et al. | |
| 6,599,394 | B1 | * | 7/2003 | Liu et al. | 162/158 |
| 6,607,783 | B1 | | 8/2003 | Vander Heiden et al. | |
| 2002/0092635 | A1 | * | 7/2002 | Capizzi | 162/158 |
| 2002/0112831 | A1 | * | 8/2002 | Barnholtz et al. | 162/123 |
| 2003/0056917 | A1 | * | 3/2003 | Jimenez | 162/158 |
| 2003/0188839 | A1 | * | 10/2003 | Urscheler | 162/123 |
| 2003/0221808 | A1 | * | 12/2003 | Capizzi | 162/135 |

FOREIGN PATENT DOCUMENTS

| | | | |
|---|---|---|---|
| EP | 0120472 | A1 | 10/1984 |
| EP | 0195458 | A1 | 9/1986 |
| EP | 0196576 | B1 | 10/1986 |
| EP | 0333212 | A2 | 9/1989 |
| EP | 0336439 | A2 | 10/1989 |
| EP | 1023863 | A1 | 2/2000 |
| EP | 1059032 | A1 | 12/2000 |
| EP | 1149947 | A2 | 10/2001 |
| EP | 1236827 | A1 | 9/2002 |
| WO | WO 9704171 | | 2/1997 |
| WO | WO 9840207 | A1 | 9/1998 |
| WO | WO 9913158 | A1 | 3/1999 |
| WO | WO 9919081 | | 4/1999 |
| WO | WO 0015907 | A1 | 3/2000 |
| WO | WO 0068503 | A1 | 11/2000 |
| WO | WO 0071177 | A1 | 11/2000 |
| WO | WO 0128337 | | 4/2001 |
| WO | WO 0129315 | | 4/2001 |
| WO | WO 0216689 | A2 | 2/2002 |
| WO | WO 0248458 | A1 | 6/2002 |

* cited by examiner

PROCESS FOR APPLYING A LIQUID ADDITIVE TO BOTH SIDES OF A TISSUE WEB

BACKGROUND OF THE INVENTION

Consumers use paper tissue products, such as paper towels, facial tissues and bath tissues, for a wide variety of applications. Facial tissues are not only used for nose care but, in addition to other uses, can also be used as a general wiping product. Consequently, there are many different types of tissue products currently commercially available.

In some applications, tissue products are treated with various additives, such as polysiloxane lotions in order to increase the softness of the facial tissue. Adding silicone compositions to a facial tissue can impart improved softness to the tissue while maintaining the tissue's strength and while reducing the amount of lint produced by the tissue during use.

In the papermaking industry, various manufacturing techniques have been specifically designed to produce paper products which consumers find appealing. Manufacturers have employed various methods to apply chemical additives, such as silicone compositions, to the surface of a paper web. Currently, one method of applying chemicals to the surface of a paper web is the rotogravure printing process. A rotogravure printing process utilizes printing rollers to transfer chemicals onto a substrate. Depending upon the configuration, the rotogravure process can be a direct printing process, an indirect printing process or an offset printing process. Chemical emulsions that are applied to webs using the rotogravure printing process typically require the addition of water, surfactants, and/or solvents in order for the emulsions to be printed onto the substrate. Such additions are not only costly but also increase drying time and add process complexity.

Another method of applying chemical additives to the surface of a tissue web is spray atomization. Spray atomization is the process of combining a chemical with a pressurized gas to form small droplets that are directed onto a substrate, such as paper. One problem posed with atomization processes is that manufacturers often find it difficult to control the amount of chemical that is applied to a paper ply. Thus, a frequent problem with spray atomization techniques is that a large amount of over-spray is generated, which undesirably builds upon machinery as well as the surfaces of equipment and products in the vicinity of the spray atomizer. Furthermore, over-spray wastes the chemical being applied, and comprises a generally inefficient method of applying additives to a tissue web. Additionally, lack of control over the spray atomization technique also affects the uniformity of application to the tissue web.

In view of the above, a need exists in the industry for improving the method for application of chemical additives to the surface of a paper web. Further, when it is necessary or desired to apply an additive to both sides of a paper product, the above-described problems can become exacerbated. As such, a need also exists for a method of applying chemical additives to both sides of a paper web.

SUMMARY OF THE INVENTION

In general, the present invention is directed to an improved process for applying compositions to paper webs, such as tissue webs, paper towels and wipers. More particularly, the present invention is directed to an improved process for applying compositions to opposite sides of a paper web in a single process line. The present invention is also directed to improved paper products made from the process.

For example, in one embodiment, the present invention is directed to a process for applying an additive to a paper web, such as a tissue web, that includes the step of extruding a viscous composition onto a first side of the paper web as the paper web is wound into a roll. The viscous composition can have a viscosity sufficient for the composition to form fibers as the compositions is extruded onto the web. In general, any suitable extrusion device can be used to apply the composition to the web. In one embodiment, for instance, the composition is extruded through a melt blown die and attenuated prior to being applied to the web.

In accordance with the present invention, the web is wound under sufficient tension to cause a portion of the composition that has been applied to the first side of the web to transfer to the second side of the web during continued winding of the web. For instance, in one embodiment, at least 10% by weight of the composition can transfer to the second side of the tissue web, and particularly at least 20% by weight of the composition can transfer the second side of the tissue web. In general, the first side of the web to which the viscous composition is initially applied can be either side of the web. For instance, the first side of the web can be the side of the web facing the center of the formed roll or can be the side of the web facing away from the center of the formed roll.

As described above, the composition being extruded onto the web can be attenuated as the composition exits the die. In one embodiment, for instance, the composition can be attenuated using an airstream that contacts the composition as it is extruded from the die. Of particular advantage, the airstream can also direct the composition on to the web at a location in close proximity to where the web is being wound into a roll. For example, the composition can be applied to the web within about 30' upstream of where the web is being wound into a roll, and particularly within about 15' upstream of where the web is being wound into a roll.

In general, any suitable paper web can be treated in accordance with the present invention. For example, the paper web in one embodiment can be uncreped through-air dried sheet. The paper web can have a bulk density of at least 2 cc/g and can have a basis weight of from about 10 gsm to about 80 gsm. The paper web can contain bulk fibers either alone or in conjunction with synthetic fibers. Further, the web can contain thermomechanical pulp. The paper web can be made from a stratified fiber furnish or it can be made from a homogeneous fiber furnish.

The composition can generally be any material that provides benefits to paper webs. For instance, the composition can be a topical preparation that improves the physical properties of the web, that provides the web with antibacterial properties, that provides the web with medicinal properties, or that provides any other type of wellness benefits to a user of the paper web. For instance, the composition can contain an anti-acne agent, an antimicrobial agent, an anti-fungal agent, an antiseptic, an antioxidant, a cosmetic astringent, a drug astringent, an aiological agent, an emollient, an external analgesic, a humectant, a moisturizing agent, a skin conditioning agent, a skin exfoliating agent, a sunscreen agent, a debonder, and mixtures thereof. In one embodiment, the composition is a softener. The softener can be, for instance, a silicone, such as a polysiloxane.

Of particular advantage, the process of the present invention is well-suited to applying relatively high viscous compositions to paper webs. For instance, the composition can have a viscosity of at least 500 cps, particularly 2000 cps and more particularly can have a viscosity of at least 3000 cps. Since the process is capable of handling high viscosity compositions, various chemical additives can be added directly to a paper web without having to dilute the additive with, for instance, water or any other type of dilution agent to form a solution or emulsion.

The amount of the composition that is applied to the paper web depends on the particular application. For example, when applying a softener to a tissue web, the softener can be added in an amount from about 0.25% to about 10% by weight and particularly from about 0.5% to about 5% by weight, based upon the weight of the web. As described above, in one embodiment, the composition is extruded through a melt blown die onto the paper web. The melt blown die can have a plurality of nozzles at a die tip. The nozzles can be arranged in one or more rows along the die tip. The fibers exiting the nozzles can have a diameter of from generally about 5 microns to about 100 microns or greater.

Various features and aspects of the present invention will be made apparent from the following detailed description.

BRIEF DESCRIPTION OF THE DRAWINGS

A full and enabling disclosure of this invention, is set forth in this specification. The following Figures illustrate the invention.

DETAILED DESCRIPTION OF THE INVENTION

Figure 1:
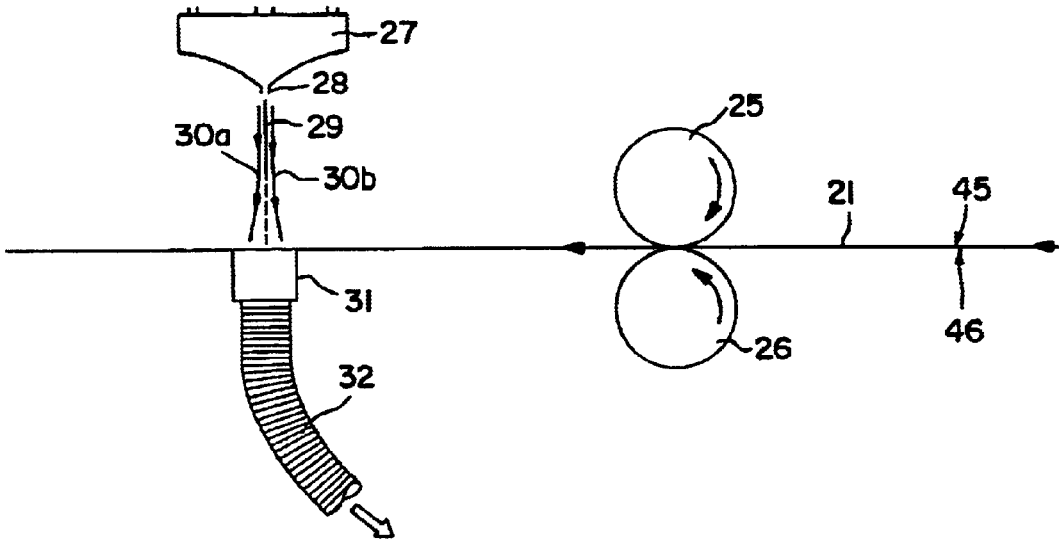
FIG. 1 is a schematic drawing showing application of an additive through a die tip onto a paper web.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in the invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to a process for applying chemical additives to opposite sides of a paper web. Specifically, the chemical additive or composition is applied to the paper web as the web is being wound into a roll. For example, by adjusting for tack, viscosity and wicking rate, it is possible to apply a chemical additive directly to one side of a paper web and have the additive transfer to the opposite side of the web during reeling, when the side of the paper web that has been treated with the chemical additive is contacted with an untreated side of the paper web as the spirally wound roll is formed. The radial force in the roll can be adjusted by adjusting web tension for ensuring that a selected amount of the additive is transferred from one side of the sheet to the other. Thus, through the process of the present invention, a paper web can be treated on both sides of the web while only applying the chemical additive in a single application.

In one embodiment of the present invention, a composition containing the chemical additive is applied to the paper web by extruding the composition through a die tip, such as a melt blown die tip. By using a melt blown die tip (sometimes referred to in the art as a uniform fiber depositor) various benefits and advantages can be obtained. For instance, it has been found that the use of a melt blown die tip provides better control over flow rates and add-on levels of the compositions being applied to the paper webs. Melt blown die tips have also been discovered to provide greater control over application rates and can apply compositions to paper webs more uniformly. Further, melt blown die tips are well-suited to applying relatively high viscous chemical additives to paper webs. All of these controls are particularly desired in the process of the present invention in order to control the amount of the chemical additive that is transferred to a non-treated side of the web while the web is being wound into a roll.

Another advantage to being able to apply relatively high viscous chemical additives to paper webs is that the additives can be applied to paper webs without first combining the additives with dilution agents, solvents, surfactants, preservatives, antifoamers, and the like. As a result, the process of the present invention can be more economical and less complex than many conventional application systems. Further, it is believed that in some applications a more viscous chemical additive not containing the above dilutants will transfer better from a first sheet to an adjacent sheet during winding.

For example, by applying the additive in a high viscosity composition, reduced spreading of the composition occurs in the plane of the sheet and reduced penetration into the interior of the sheet. This results in reduced strength degradation of the sheet. Further, removing the water phase from the chemical additive prevents microbial growth.

In one embodiment, a composition containing a chemical additive in accordance with the present invention can be applied to a paper web in the form of fibers. Specifically, it has been discovered that under certain circumstances, compositions applied in accordance with the present invention will fiberize when extruded through the melt blown die tip. The ability to fiberize the compositions provides various advantages. For example, when formed into fibers, the composition is easily captured by the paper web. The fibers can also be placed on the web in specific locations. Further, when desired, the fibers will not penetrate through the entire thickness of the web, but instead, will remain on the surface of the web where the chemical additives are intended to provide benefits to the consumer and where the additive will transfer better to an adjacent sheet.

Another advantage of the present invention is that for some applications, a lesser amount of the chemical additive can be applied to the web than what was necessary in many two-sided conventional application processes while still obtaining an equivalent or better result. In particular, it is believed that since the chemical additive can be applied in a relatively viscous form without having to be formed into an emulsion or a solution and because the chemical additive can be applied as fibers uniformly over the surface of a web, it is believed that the same or better results can be obtained without having to apply as much of the chemical additive as was utilized in many prior art processes.

Possible ingredients or chemical additives that can be applied to paper webs in accordance with the present invention include, without limitation, debonders, anti-acne actives, antimicrobial actives, antifungal actives, antiseptic actives, antioxidants, cosmetic astringents, drug astringents, aiological additives, deodorants, emollients, external analgesics, film formers, fragrances, humectants, natural moisturizing agents and other skin moisturizing ingredients known in the art, opacifiers, skin conditioning agents, skin exfoliating agents, skin protectants, solvents, sunscreens, and surfactants. The above chemical additives can be applied alone or in combination with other additives in accordance with the present invention.

In one embodiment of the present invention, the process is directed to applying a softener to a tissue web. The softener can be, for instance, a polysiloxane that makes a tissue product feel softer to the skin of a user. Suitable polysiloxanes that can be used in the present invention include amine, aldehyde, carboxylic acid, hydroxyl, alkoxyl, polyether, polyethylene oxide, and polypropylene oxide derivatized silicones, such as aminopolydialkylsiloxanes. When using an aminopolydialkysiloxane, the two alkyl radicals can be methyl groups, ethyl groups, and/or a straight branched or cyclic carbon chain containing from about 3 to about 8 carbon atoms. Some commercially available examples of polysiloxanes include WETSOFT CTW, AF-21, AF-23 and EXP-2025G of Kelmar Industries, Y-14128, Y-14344, Y-14461 and FTS-226 of the Witco Corporation, and Dow Corning 8620, Dow corning 2-8182 and Dow Corning 2-8194 of the Dow Corning Corporation.

In the past, polysiloxanes were typically combined with water and surfactants, such as nonionic ethoxylated alcohols, to form emulsions and applied to tissue webs. Since the process of the present invention can accommodate higher viscosities, however, the polysiloxanes can be added directly to a paper web without having to be combined with water, a surfactant or any other dilution agent. For example, a neat composition, such as a neat polysiloxane can be applied to a web in accordance with the present invention. Of course, if desired, the polysiloxane can be applied to the web as an emulsion in accordance with the present invention.

Applying neat chemical additives, particularly neat polysiloxanes in accordance with the present invention, provides various advantages and benefits. For example, applying the chemical additive in neat form may be less expensive in some applications due to the elimination of any emulsification process for the product. Eliminating the water phase of the product also reduces any chance of microbial growth, eliminating the necessity to include preservatives or antimicrobial agents. Another advantage is that the add-on rates of the composition can be decreased since the additive is being applied in a more pure form. Further, the chemical additive may be more effective in providing benefits to the paper web in the absence of any diluents.

Still another advantage to applying compositions that contain relatively low amounts of water is that the base sheet may not need to be dried after the composition is applied. Furthermore, water can have an adverse impact on some tissue products that are sensitive to moisture. For example, some tissue products if treated with water and dried will loose some of their aesthetic appeal by wrinkling and possibly puckering.

Referring to FIG. 1, one embodiment of a melt blown die that can be used in accordance with the present invention is illustrated.

As shown, a tissue web 21 moves from the right to the left and is comprised of a first side 45 that faces upwards and a second side 46 that faces downward. The tissue web 21 receives a composition stream 29 upon its first side 45.

In general, the composition stream 29 is applied to the web 21 after the web has been formed. The composition can be applied to the web, for instance, after the web has been formed and prior to being wound. Alternatively, the composition can be applied in a post treatment process in a rewinder system. As illustrated in FIG. 1, the web 21 can be calendared, using calendar rolls 25 and 26 prior to application of the composition. The calendar rolls can provide a smooth surface for making the product feel softer to a consumer.

As shown in the figures, a composition containing a chemical additive is extruded to form a composition stream 29 that is directed onto the web 21. In general, any suitable extrusion device can be used in accordance with the present invention. In one embodiment, for instance, the extruder includes a melt blown die 27. A melt blown die is an extruder that includes a plurality of fine, usually circular, square or rectangular die capillaries or nozzles that can be used to form fibers. In one embodiment, a melt blown die can include converging high velocity gas (e.g. air) streams which can be used to attenuate the fibers exiting the nozzles. The air streams can exit the die through slots or orifices. One example of a melt blown die is disclosed, for instance, in U.S. Pat. No. 3,849,241 to Butin, et al which is incorporated herein by reference.

As shown in FIG. 1, melt blown die 27 extrudes the viscous composition stream 29 from die tip 28. As illustrated, the melt blown die can be placed in association with an air curtain 30*a–b*. The air curtain 30*a–b* may completely surround the extruded composition stream 29, while in other applications the air curtain 30*a–b* may only partially surround the composition stream 29. When present, the air curtain can facilitate application of the composition to the paper web, can assist in forming fibers from the composition being extruded and/or can attenuate any fibers that are being formed. Depending upon the particular application, the air curtain can be at ambient temperature or can be heated.

In one embodiment, a suction device 31 can be located beneath the melt blown die 27. The suction device 31 assists in placing the formed fibers made from the composition onto the web 21. For example, in one embodiment, the suction device 31 can be a vacuum source, such as a vacuum box. The vacuum source 31 can be in the form of a straight slot extending across the width of the sheet. The slot can be, for instance, from about ⅛ inch to about 1 inch wide, such as approximately ½ inch wide. Alternatively, the vacuum source 31 can include a series of holes arranged to give an equivalent slot width as cited above. In certain applications, a series of holes can be used for improving sheet support and resistance to the vacuum. The vacuum box 31 as shown in FIG. 1 is in communication with a conduit 32. The conduit 32 can be placed in communication with a vacuum pump located in a remote location from the process. The vacuum pump can be used to create a vacuum and suction force below the web 21.

The vacuum source 31 exerts a force on the sheet which assists in the deposition of the chemical threads on the sheet. Further, the vacuum source 31 also accommodates the process air that is used to form the threads.

In an alternative embodiment, the suction device 31 can be a chamber containing an exhaust fan. The exhaust fan 31 is provided to improve air flow and to employ a pneumatic force to pull the composition stream 29 down on to the first side 45 of the tissue web 21. The exhaust fan 31 serves to remove from the immediate vicinity airborne particles or other debris through an exhaust duct 32. The exhaust fan 31 operates by pulling air using a rotating propeller positioned adjacent the web.

Figure 2:
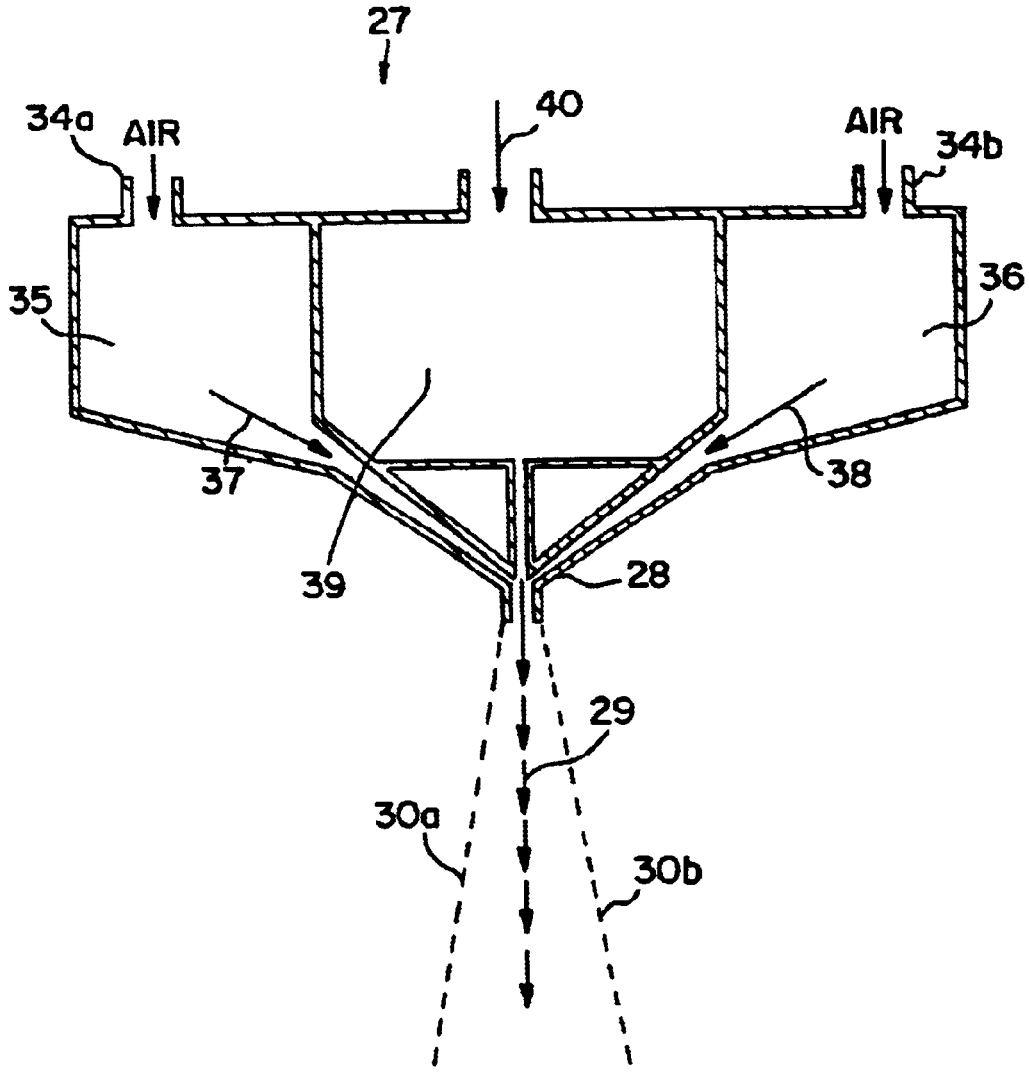
FIG. 2 is a side view of one embodiment of a melt blown die that can be used in accordance with the present invention.

In FIG. 2, a more detailed view of the melt blown die 27 is shown in which air intake 34*a–b* brings air into the melt blown die 27. Air travels into air duct 35 and air duct 36, respectively, from air intake 34*a* and 34*b*. The air proceeds along air pathway 37 and air pathway 38, respectively, to a point near the center of die tip 28 at which the air is combined with viscous composition 40 containing the desired chemical additives that emerges from a reservoir 39 to die tip 28. Then, the composition travels downward as viscous composition stream 29, shielded by air curtain 30*a–b*.

Figure 3:
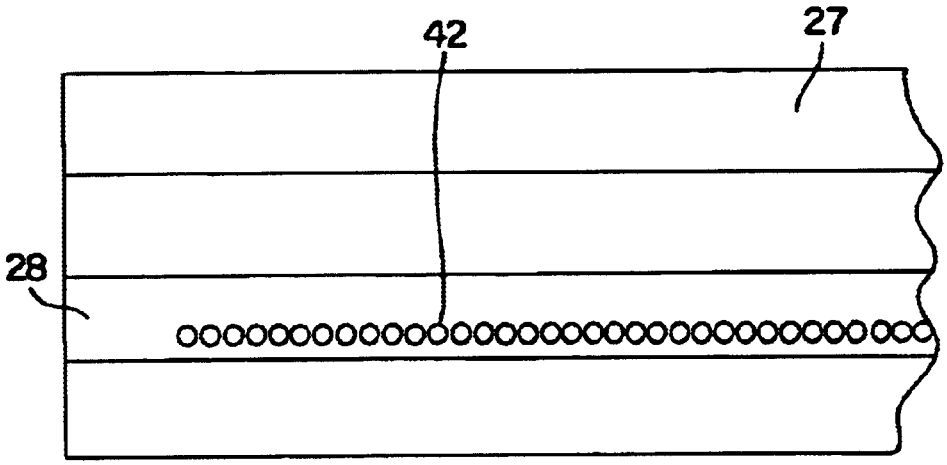
FIG. 3 is a bottom view of a portion of the melt blown die illustrated in FIG. 2 showing, in this embodiment, a row of nozzles through which an additive is extruded.

FIG. 3 shows a bottom view of the melt blown die 27 as it would appear looking upwards from the tissue web 21 (as shown in FIG. 1) along the path of the composition stream 29 to the point at which it emerges from die tip 28. In one embodiment, the melt blown die 27 is comprised of orifices 42 (several of which are shown in FIG. 3), and such orifices 42 may be provided in a single row as shown in FIG. 3. In other embodiments, there could be only a few scattered orifices 42; or perhaps, instead, a number of rows or even a series of channels could be used to release the composition stream 29 from melt blown die 27. In some cases, a combination of channels and orifices 42 could be used. In other cases (not shown), multiple rows of openings could be provided, and there is no limit to the different geometrical arrangement and patterns that could be provided to the melt blown die 27 for extruding a composition stream 29 within the scope of the invention.

In one specific embodiment of the invention, a pressurized tank (not shown) transfers a gas, such as air, to the melt blown die 27 for forcing the composition through the die tip. Composition 40 is forced through the melt blown die 27 and extruded through, for instance, nozzles spaced along the length of the die tip. In general, the size of the nozzles and the amount of the holes located on the melt blown die tip can vary widely depending upon the particular application.

For example, in one embodiment, the nozzles can have a diameter from about 1 mil to about 50 mils or larger, and particularly from about 5 mils to about 25 mils. The nozzles can be spaced along the die tip in an amount from about 3 nozzles per inch to about 50 nozzles per inch, and particularly from about 5 nozzles per inch to about 30 nozzles per inch. For example, in one embodiment, a die tip can be used that has approximately 17 nozzles per inch, and wherein each nozzle has a diameter of about 14 mils.

In one particular embodiment, a melt blown die can be used that is also known as a uniform fiber depositor. In this embodiment, the melt blown die can contain, for instance, from about 5 liquid nozzles per inch to about 17 liquid nozzles per inch. The nozzles can have dimensions varying from about 0.008 inch by about to 0.008 inch to about 0.012 inch by about 0.012 inch. Each of the nozzles can be surrounded by from about 2 to about 4 air orifices or ports. The air orifices can have dimensions of from about 0.020 inch by about 0.024 inches to about 0.020 inch by about 0.012 inches. It should be understood, however, that the present invention is not limited by the above dimensions. In particular, the nozzle dimensions and the air orifice dimensions can be much greater or much smaller than the dimensions listed above.

As shown in the drawings, two streams of pressurized air converge on either side of the composition stream 29 after it exits the melt blown die 27. It should be understood, however, that many further streams of air can be also used. For example, in one embodiment, four streams of pressurized air can converge on the compositions stream 29. The resulting air pattern disrupts the laminar flow of the composition stream 29 and attenuates the fibers being formed as they are directed onto the surface of the web.

In general, the fibers that can be formed according to the present invention include discontinuous fibers and continuous fibers. The fibers can have various diameters depending upon the particular application. For instance, the diameter of the fibers can vary from about 5 microns to about 100 microns. In one embodiment, continuous fibers are formed having a diameter of about 25 microns.

Figure 4:
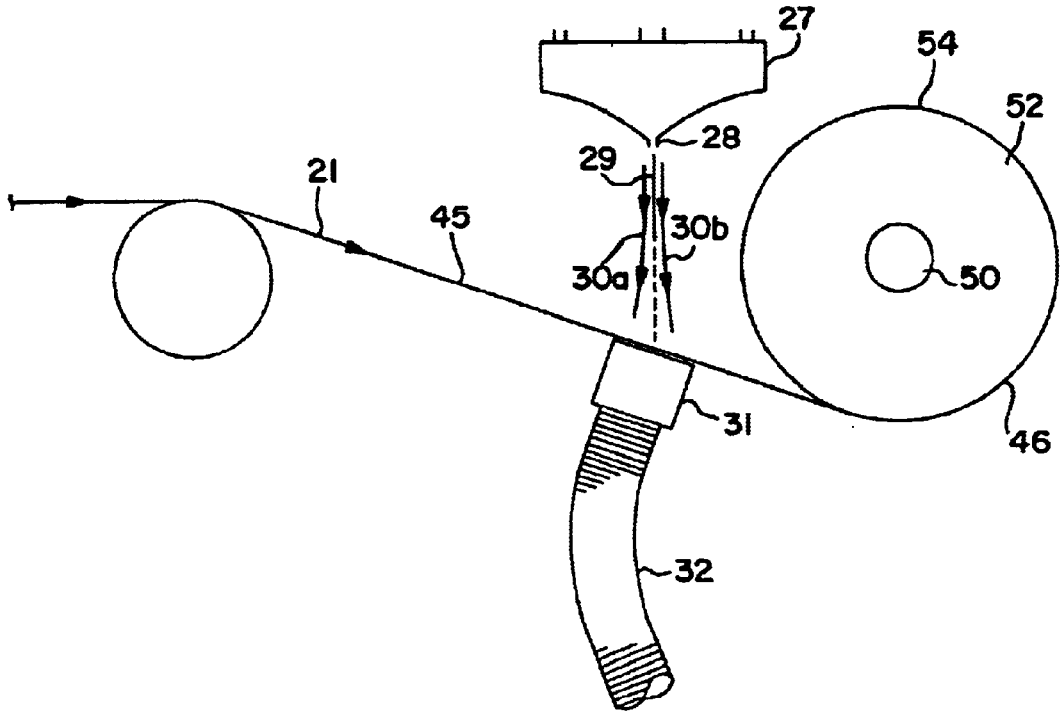
FIG. 4 is a schematic drawing showing application of an additive to a paper web using the die tip illustrated in FIG. 1 while the paper web is being wound into a roll in accordance with the present invention. Repeated use of reference characters in the present specification and drawings is intended to represent the same or analogous features of the invention.

Referring to FIG. 4, one embodiment of a process in accordance with the present invention is shown. As illustrated, the melt blown die 27 shown in FIG. 1 is positioned adjacent to a reel 50 used to wind the paper web 21 into a roll 52. In this embodiment, the composition stream 29 is extruded and directed onto a first side 45 of the paper web 21 as the paper web is being wound into the roll 52. Once applied to the paper web 21, in accordance with the present invention, a portion of the composition then transfers to the second and opposite side 46 of the paper web 21 during the winding process. As described above, the amount of the composition that is applied to the second side of the web is controlled by controlling the properties of the web, the viscosity of the composition, and the tension in the sheet during winding. During the process, at least 3% by weight of the composition applied to the first side can be transferred to the second side of the sheet, particularly at least 5% by weight of the composition can be transferred to the second side of the sheet, and more particularly at least 10% of the composition can be applied to the second side of the sheet. For example, in one embodiment, greater than 20% by weight of the composition can be transferred to the second side of the sheet as the sheet as wound into the roll 52.

In the embodiment illustrated in FIG. 4, the composition 29 is being applied to the side of the paper web 21 that faces the reel 50. Alternatively, however, it should be understood that the composition can also be applied initially to the opposite side of the sheet and then transferred to the side 45 of the sheet. For instance, the melt blown die 27, instead of being placed adjacent the formation of the wound roll 52, can be placed adjacent to the wound roll itself, such as at location 54. At location 54, the melt blown die applies the composition 29 to the side 46 of the paper web 21.

When the composition 29 is being applied to the side 45 of the paper web 21, in general, the melt blown die should be positioned relatively close to the formation of the wound roll 52. For example, for many applications, the melt blow die 27 should be placed within about 30' of the wound roll 52 and particularly within about 15' of the wound roll 52.

Prior to being wound into the roll 52, if necessary, the paper web can be dried depending upon the particular composition being applied to the web. Any suitable drying device can be used to evaporate any unwanted moisture. For example, the web can be dried by a convective oven, a microwave oven, an infrared heater, and the like. In one embodiment, for example, hot air can be directed over and/or through the web.

As stated above, use of the melt blown die 27 in the process of the present invention offers various benefits and advantages. For instance, the melt blown die can use relatively high viscous compositions and can form fibers when desired. As also described above, the melt blown die 27 is used in conjunction with an air curtain 30*a–b* for directing the composition onto the fiber. Besides attenuating the fibers, however, it has been discovered that the air curtain can also be used to assist in depositing the composition at a desired location. For instance, the airstreams can be used to propel the composition between the sheet layers.

The flow rate of the composition will depend on the chemical additive being applied to the paper web, on the speed of the moving paper web, and on various other factors. In one embodiment, for instance, the flow rate of the composition can be from about 2 grams/minutes/inch to about 9 grams/minute/inch. In general, the total add on rate of the composition (including add on to both sides of the web) can be up to about 10% based upon the weight of the paper web. When applying a softener to the paper web, for instance, the add on rate can be from about 0.25% to about 5% by weight.

The viscosity of the composition can also vary depending upon the particular circumstances. When it is desired to produce fibers through the melt blown die, the viscosity of the composition should be relatively high. For instance, the viscosity of the composition can be at least 1000 cps, particularly greater than about 2000 cps, and more particularly greater than about 3000 cps. For example, the viscosity of the composition can be from about 1000 to about 50,000 cps and particularly from about 2000 to about 10,000 cps. In alternative embodiments, where it is not necessary to produce fibers, the viscosity of the composition can be less than about 1000 cps, such as less than about 500 cps.

In one embodiment, as described above, the composition applied to the paper web can contain relatively low levels of water. For example, in many conventional processes, compositions were applied to paper webs containing at least 40% by weight water. The system of the present invention, however, is capable of applying highly viscious compositions to paper webs. As such, in some embodiments, the composition need not be diluted with water at conventional levels. For instance, compositions of the present invention can contain water in an amount less than 20% by weight, particularly less than 10% by weight, and more particularly in an amount less than 5% by weight. For example, in one embodiment, the composition can contain water in an amount less than 3% by weight.

In one particular embodiment, a neat chemical additive can be applied to the paper web in accordance with the present invention, such as a neat polysiloxane. By applying the composition in a neat form, the requirement to dry the paper web prior to winding the web into a roll may be alleviated. Further, by eliminating water in the composition, the structure of the base web may be better preserved. For example, some uncreped through-air dried base webs can be sensitive to water; the caliper or thickness of the sheet is affected by the moisture content during the reeling of the sheet.

The temperature of the composition as it is applied to a paper web in accordance with the present invention can vary depending upon the particular application. For instance, in some applications, the composition can be applied at ambient temperatures. In other applications, however, the composition can be heated prior to or during extrusion. The composition can be heated, for instance, in order to adjust the viscosity of the composition. The composition can be heated by a pre-heater prior to entering the melt blown die or, alternatively, can be heated within the melt blown die itself using, for instance, an electrical resistance heater.

Examples of additives that may need to be heated prior to being deposited on a paper web include compositions containing behenyl alcohol. Other compositions that may need to be heated include compositions that contain a wax, that contain any type of polymer that is a solid at ambient temperatures, and/or that contain a silicone. One particular embodiment of a composition that may need to be heated in accordance with the present invention is the following:

| INGREDIENT | WEIGHT PERCENT |
|---|---|
| Mineral Oil | 25 |
| Acetylated Lanolin Alcohol (ACETULAN available from Amerchol) | 10 |
| Tridecyl Neopentoate | 10 |
| Cerasin Wax | 25 |
| DOW Corning 200 20 cSt | 30 |

The above composition is well suited for use as a lotion when applied to a cellulosic web.

The above compositions can be heated to a temperature, for instance, from about 75° C. to about 150° C.

When applied to the paper web, the composition can cover the entire surface area of the web or a portion of the web. For example, the composition can be applied so as to cover from about 20% to about 80% of the surface area of the web, and particularly from about 30% to about 60% of the surface area of the web. By leaving untreated areas on the web, the web remains easily wettable, which can be a concern when applying hydrophobic additives.

The process of the present invention can be used to apply compositions and chemical additives to numerous and various different types of products. For most applications, however, the present invention is directed to applying chemical additives to paper products, particularly wiping products. Such products include facial tissues and bath tissues that have a basis weight of less than about 60 gsm, and particularly from about 20 gsm to about 60 gsm, and more particularly from about 25 gsm to about 45 gsm. The tissue web can be made exclusively of pulp fibers or, alternatively, can contain pulp fibers mixed with other fibers.

Besides bath and facial tissue products, however, the process of the present invention can also be applied to paper towels and industrial wipers. Such products can have a basis weight of up to about 200 gsm and particularly up to about 150 gsm. Such products can be made from pulp fibers alone or in combination with other fibers, such as synthetic fibers. The pulp fibers can be softwood fibers, hardwood fibers, thermomechanical pulp, and the like.

The paper web treated in accordance with the present invention can also be formed by any of a variety of paper making processes known in the art. In fact, it is believed that any process capable of forming a paper web can be utilized in the present invention. For example, the paper web treated in accordance with the present invention can be creped, wet-creped, double-creped, embossed, wet-pressed, air pressed, through-air dried, creped through-air dried, uncreped through-air dried, and the like. Examples of paper webs that can be used in the present invention include those disclosed in U.S. Pat. No. 5,048,589 to Cook, et al.; U.S. Pat. No. 5,399,412 to Sudall, et al.; U.S. Pat. No. 5,129,988 to Farrington, Jr.; U.S. Pat. No. 5,494,554 to Edwards, et al., which are all incorporated herein by reference.

In one particular embodiment of the present application, the paper web treated in the process of the present invention is an uncreped through-air dried web. Uncreped through-air dried webs are generally formed in a wet paper making process in which a slurry of fibers is deposited onto a forming fabric. To dry the formed web, the web is fed through a through-air dryer while the web is being supported by a dryer fabric. Once formed, the web can have a fabric side that is generally softer to the touch than the opposite side of the web. In one embodiment of the present invention, a composition is applied opposite the fabric side and then transferred to the fabric side when wound into a roll. When applying, for instance, softeners to paper webs, less composition is generally needed on the fabric side.

It is to be understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed:

1. A process for applying a composition to a paper product comprising:

providing a paper web, the paper web having a bulk density of at least 2 cc/g, the paper web having a first side and a second side;

winding the paper web into a roll;

extruding a composition onto the first side of the paper web as the web is being wound into the roll, the composition being extruded through a die tip, the composition being contacted with an airstream upon exiting the die tip, the airstream directing the composition onto the paper web, wherein the composition has a determined viscosity and the web is under sufficient tension to cause a portion of the composition to transfer to the second side of the paper web during continued winding of the web and;

wherein a suction device is positioned adjacent to the paper web opposite the die tip, the suction device creating a suction for assisting in directing the composition onto the web and in removing the air stream exiting the die tip.

2. A process as defined in claim 1, wherein the first side of the paper web is the side of the web facing the center of the formed roll as the roll is wound.

3. A process as defined in claim 2, wherein the composition is applied to the first side of the paper web within about 15 feet upstream of where the paper web is being wound into the roll.

4. A process as defined in claim 1, wherein the first side of the paper web is the side of the web facing away from the center of the formed roll as the roll is wound.

5. A process as defined in claim 1, wherein at least 10% by weight of the additive transfers to the second side of the paper web.

6. A process as defined in claim 1, wherein at least 20% by weight of the composition transfers to the second side of the paper web.

7. A process as defined in claim 1, wherein the composition comprises a silicone.

8. A process as defined in claim 7, wherein the composition further comprises a debonder.

9. A process as defined in claim 1, wherein the paper web comprises an uncreped through air dried sheet.

10. A process as defined in claim 1, wherein the composition is formed into fibers as it is extruded through the die tip, the airstream attenuating the fibers prior to contacting the paper web.

11. A process as defined in claim 10, wherein the paper web contains synthetic fibers.

12. A process as defined in claim 1, wherein the paper web has a basis weight of from about 10 gsm to about 80 gsm.

13. A process as defined in claim 1, wherein the composition comprises a neat polysiloxane.

14. A process as defined in claim 1, wherein the composition is applied to the first side of the paper web in an amount of from about 0.25% to about 10% by weight of the sheet.

15. A process as defined in claim 1, wherein the composition has a viscosity of at least 500 cps.

16. A process as defined in claim 1, wherein the composition is applied to the paper web in a neat form.

17. A process for applying a composition to a paper product comprising:

providing a paper web containing pulp fibers, the paper web having a bulk density of at least 2 cc/g, the paper web having a first side and a second side;

winding the paper web into a roll; and extruding an composition onto the first side of the paper web as the web is being wound into the roll, the composition being extruded through a die tip, the composition having a viscosity sufficient for the composition to form fibers as the composition is extruded through the die tip, the fibers being attenuated by an airstream prior to contacting the paper web, wherein the web is under sufficient tension to cause a portion of the composition to transfer to the second side of the paper web during continued winding of the web, at least 10% by weight of the composition being transferred to the second side of the web.

18. A process as defined in claim 17, wherein a suction device is positioned adjacent to the paper web opposite the die tip, the suction device creating a suction for assisting in directing the composition onto the web and in removing the air stream exiting the die tip.

19. A process as defined in claim 17, wherein the first side of the paper web is the side of the web facing the center of the formed roll.

20. A process as defined in claim 17, wherein the first side of the paper web is the side of the web facing away from the center of the formed roll.

21. A process as defined in claim 17, wherein at least 20% by weight of the composition transfers to the second side of the paper web.

22. A process as defined in claim 17, wherein the composition contains a polysiloxane softener.

23. A process as defined in claim 22, wherein the composition comprises a neat polysiloxane.

24. A process as defined in claim 17, wherein the paper web comprises an uncreped through air dried sheet.

25. A process as defined in claim 17, wherein the composition has a viscosity of at least 2000 cps.

26. A process as defined in claim 17, wherein the paper web contains thermomechanical pulp.

27. A process as defined in claim 17, wherein the composition is in a neat form.

28. A process for applying a composition to an uncreped through-air dried sheet comprising:

providing a paper web containing pulp fibers, the paper web having a bulk density of at least 2 cc/g and a basis weight of from about 10 gsm to about 80 gsm, the paper web having a first side and a second side;

winding the paper web into a roll; and extruding an composition onto the first side of the paper web as the web is being wound into the roll, the composition being in a neat form, wherein the web is wound under sufficient tension to cause at least 10% by weight of the composition to transfer from the first side of the web to the second side of the web during continued winding into the roll and;

wherein the composition is extruded through a melt blown die, the composition having a viscosity sufficient to form fibers as the composition is extruded through the melt blown die, the fibers being attenuated by a stream of air prior to being deposited onto the paper web, the stream of air also directing fibers onto the web.

29. A process as defined in claim 28, wherein the composition has a viscosity of at least 2000 cps.

30. A process as defined in claim 28, wherein the composition comprises neat polysiloxane.

31. A process as defined in claim 30, wherein the composition is extruded through a melt blown die, the composition having a viscosity sufficient to form fibers as the composition is extruded through the melt blown die, the fibers being attenuated by a stream of air prior to being deposited onto the paper web, the stream of air also directing fibers onto the web.

* * * * *

UNITED STATES PATENT AND TRADEMARK OFFICE

CERTIFICATE OF CORRECTION

PATENT NO. : 6,761,800 B2
DATED : July 13, 2004
INVENTOR(S) : Joseph G. Capizzi

It is certified that error appears in the above-identified patent and that said Letters Patent is hereby corrected as shown below:

Title page,
Item [56], References Cited, FOREIGN PATENT DOCUMENTS, add
-- DE 252208, 10/1912 -- and -- EP 0098362 B1, 1/1984 --

Signed and Sealed this

Twenty-eighth Day of June, 2005

JON W. DUDAS
*Director of the United States Patent and Trademark Office*